United States Patent [19]

Dick

[11] Patent Number: 4,728,864

[45] Date of Patent: Mar. 1, 1988

[54] AC PLASMA DISPLAY

[75] Inventor: George W. Dick, Sinking Spring, Pa.

[73] Assignee: American Telephone and Telegraph Company, AT&T Bell Laboratories, Murray Hill, N.J.

[21] Appl. No.: 835,356

[22] Filed: Mar. 3, 1986

[51] Int. Cl.[4] ..... G09G 3/10

[52] U.S. Cl. ..... 315/169.3; 313/582; 313/585; 340/775

[58] Field of Search ..... 315/169.3, 169.4; 313/582, 585, 491, 492; 340/771, 773, 775

[56] References Cited

U.S. PATENT DOCUMENTS

| | | | |
|---|---|---|---|
| Re. 29,629 | 5/1978 | Ogle | 313/582 |
| 3,749,969 | 7/1973 | Miyashiro et al. | 313/582 |
| 4,164,678 | 8/1979 | Biazzo et al. | 313/582 |
| 4,336,535 | 1/1982 | Albertine, Jr. | 315/169.4 |
| 4,554,537 | 11/1985 | Dick | 313/491 |
| 4,574,280 | 3/1986 | Weber | 315/169.4 |
| 4,629,942 | 12/1986 | Horio et al. | 315/169.4 |
| 4,638,218 | 1/1987 | Shinoda et al. | 315/169.4 |

OTHER PUBLICATIONS

U.S. patent application of R. J. Braude, Ser. No. 684,783 filed Dec. 21, 1984.

*Primary Examiner*—Saxfield Chatmon
*Attorney, Agent, or Firm*—Lester H. Birnbaum

[57] ABSTRACT

An AC plasma display with enhanced resolution is disclosed. The display includes at least three electrodes per pel with at least one electrode electrically connected in common with other electrodes for the purpose of providing common sustain signals to the pels. The common electrodes are divided into at least two interleaved sets so that adjacent vertical pels can be separately biased during the sustain phase. In accordance with one embodiment of the invention, sustain signals are applied in two phases alternatively to the sets of common electrodes. In accordance with another embodiment of the invention, the sustain signals are applied to both sets simultaneously, but with an opposite polarity.

12 Claims, 10 Drawing Figures

AC PLASMA DISPLAY

BACKGROUND OF THE INVENTION

This invention relates to AC plasma displays.

AC plasma displays are currently the subject of great interest as possible replacements for CRTs and for use in other applications requiring compactness and high resolution. Basically, such displays include a substrate and cover with a gap therebetween which enclose an ionizable gas such as neon or argon. Formed on the substrate is an array of electrodes (hereinafter "Y" electrodes) oriented in one direction, which array is covered by an insulating layer. Placed over the first array, either on the insulating layer over the substrate or over the cover, is a second array of electrodes (hereinafter "X" electrodes) extending in an orthogonal direction. This array is also covered by an insulating layer. Display pels are formed at the crosspoints of the electrodes of the two arrays. Pels are selected for display by application of an appropriate write pulse to the electrodes of the first and second arrays to locally ionize the gas and cause a luminous discharge. Charge will also collect on the insulating layers over the selected electrodes. By applying a lower amplitude AC sustain signal to all electrodes, the selected pels will remain in an "on" state as a result of the added potential provided by the collected charge which allows continued gas discharges in those areas. An appropriate erase signal can be applied to the selected electrodes to dissipate this charge and turn off the pel.

Recently, it has been proposed to provide displays with three or more electrodes per pel in order to simplify the write/arase and sustain circuitry (see U.S. Pat. No. 4,554,537 issued to G. W. Dick on Nov. 19, 1985 and assigned to the present assignee, which is incorporated by reference herein). In a basic embodiment of that invention, the Y electrodes comprise a plurality of pairs of electrodes arranged in rows with one of each electrode pair being electrically coupled in common while the other electrode in each pair is separately addressable. Each pel, therefore, comprises a pair of Y electrodes and an X electrode placed orthogonally thereto. A pel is selected for display by applying a write pulse to the separately addresable Y electrode and the orthogonal X electrode. Charge collected over the X electrode is then transferred to over the common Y electrode in the pel by application of a pulse thereto. The selected pels remain "on" by applying an AC sustain signal to both electrodes in each Y electrode pair so that the signals to each electrode in a pair have an opposite polarity and a magnitude such that they cause discharge of the gas only in the pels where charge has been previously collected. Appropriate erase signals can be applied in the sequence described above to remove charge in pels which are to be extinguished.

While such a display should be adequate for most applications, a potential problem exists if the Y electrodes are brought very close together to achieve higher resolution as might be necessary, for example, in color displays where three color pixels are used as each display site. In devices with high line densities, typically 100 or more lines per inch might be utilized and a spacing of 3 mils or less between adjacent electrode pairs may be needed. In such cases, it is possible for charge in an active (on) pel to be transferred to an adjacent inactive (off) pel during the application of the sustain signals. This undesired charge buildup could be sufficient to initiate a discharge in the inactive pel.

It is, therefore, a primary object of the invention to provide an AC plasma display which is capable of higher line densities and, therefore, higher resolution.

SUMMARY OF THE INVENTION

This and other objects are achieved in accordance with the invention which, in one aspect, is a display device comprising first and second substrates placed so as to define a gap region between them with a gas capable of forming a glow discharge occupying the gap. First and second arrays of electrodes are formed in the gap region, covered by dielectric layers, and positioned to form crosspoint regions between the electrodes of the two arrays. The first array comprises a plurality of at least pairs of electrodes spaced at least in the crosspoint regions so that a glow discharge may be sustained at the surface of the dielectric in said regions. The invention is characterized by the fact that one electrode of each pair in the first array is capable of being biased independently of all other electrodes in the first array and the other electrodes in each pair is electrically coupled in common to electrodes in other pairs, the common electrodes being formed in at least two sets of electrodes which are capable of being independently biased.

In accordance with a further aspect, the invention is a method of operating a display device which includes first and second substrates placed so as to define a gap region between them with a gas capable of forming a glow discharge occupying the gap, and first and second arrays of electrodes formed in the gap region, which electrodes are covered by dielectric layers and positioned to form crosspoint regions between the electrodes of the two arrays, and where the first array comprises a plurality of at least pairs of electrodes spaced at least in the crosspoint regions so that a glow discharge may be sustained at the surface of the dielectric between the electrode of each pair in the crosspoint regions. The method involves sustaining the glow discharge at selected crosspoint regions comprising the steps of applying an AC signal to both electrodes of each pair in different phases so that adjacent pairs have different signals applied thereto at a particular time.

BRIEF DESCRIPTION OF THE DRAWING

These and other features of the invention are delineated in detail in the following description.

In the drawing.

It will be appreciated that, for purposes of illustration, these figures are not necessarily drawn to scale.

DETAIL DESCRIPTION

Figure 1:
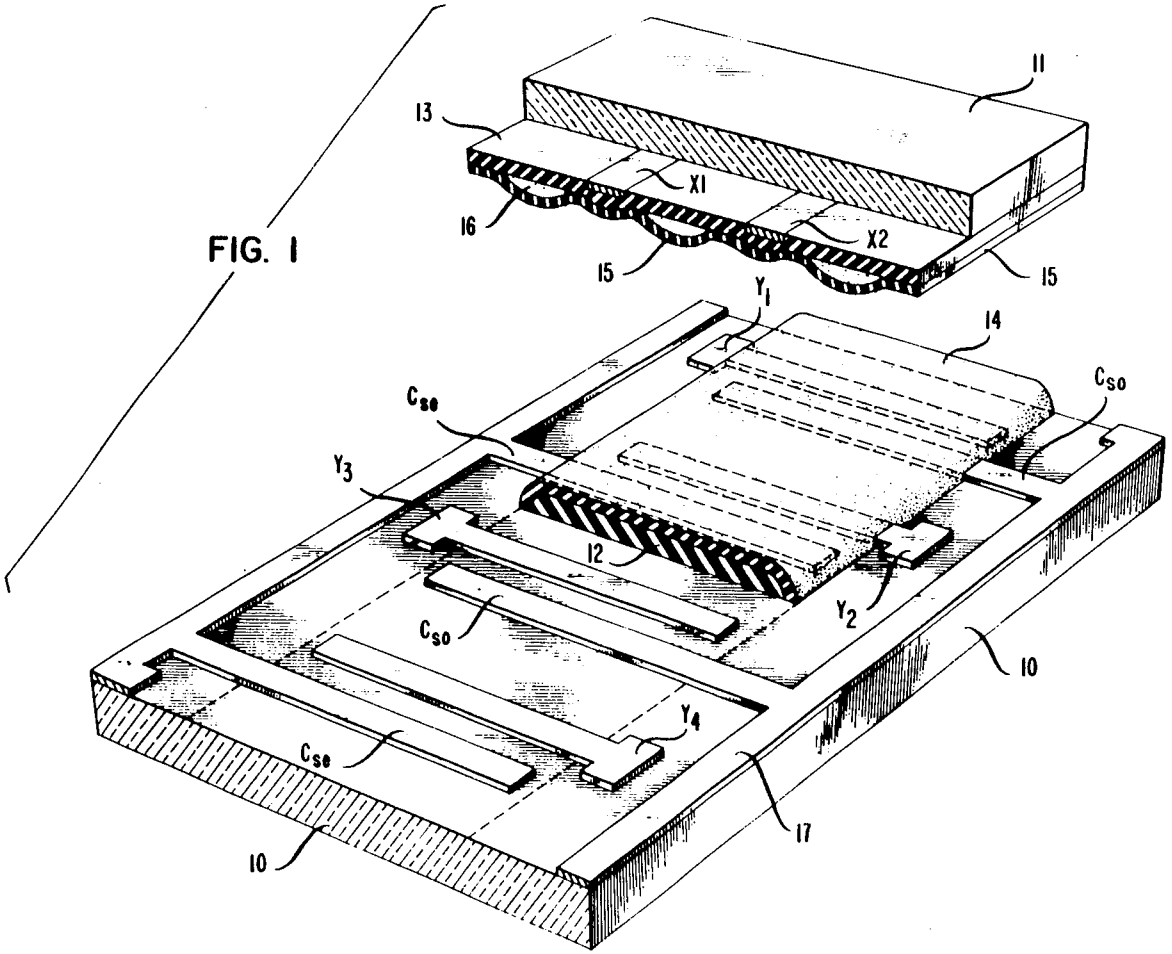
FIG. 1 is a partly schematic, exploded, perspective view of a display device in accordance with one embodiment of the invention.

The basic principles of the invention will be described with reference to the particular structure illustrated in the exploded view of FIG. 1. For purposes of illustration, a 2×4 array of display pels is shown. Of course, a commercial device would actually employ a far greater number of electrodes. The device includes two insulating substrates, 10 and 11, upon which electrode arrays are formed. (The substrate 11 is also typically termed the "cover".) These substrates are usually made of glass. Parallel electrodes $X_1$ and $X_2$ are formed on the surface of the top substrate, 11, while in array of electrodes $Y_1$–$Y_4$, $C_{se}$ and $C_{so}$, are formed on the surface of substrate 10 in a direction orthogonal to that of electrodes $X_1$ and $X_2$. These electrodes are typically made of aluminum and are deposited by sputtering or evaporation. The portion of each electrode in the display area is covered by an insulating layer, which in this example is actually a dual-layer insulator comprising a thick layer of low melting point solder glass (12, 13) and a thin layer of thermally evaporated MgO (14, 15). These layers are typically approximately 1 mil and 2000 Angstroms thick, respectively. Also included over substrate 11 between the X electrodes is an array of ribs, 16, which, as known in the art, can provide isolation between adjacent pels in the direction along the Y electrodes (hereinafter the "horizontal" direction). In this example, the ribs are screen printed and fired to a thickness of approximately 0.003 inches. The ribs may be printed over the substrate 10 rather than the cover 11 but with the same vertical orientation as shown in FIG. 1.

Figure 2:
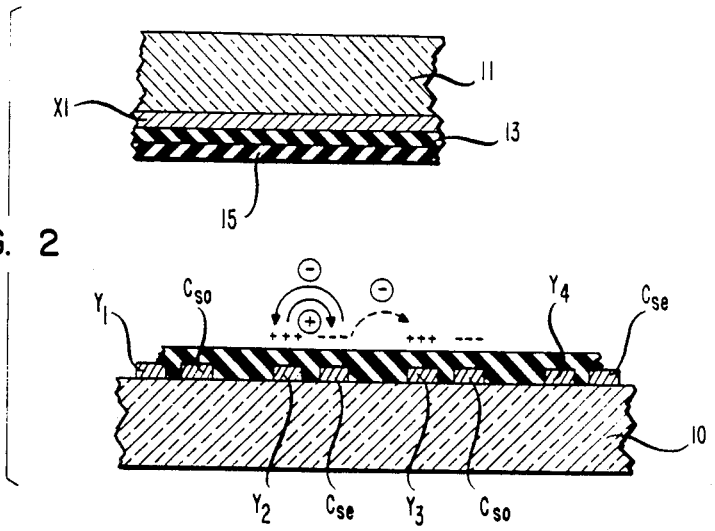
FIGS. 2 and 3 are cross-sectional schematic views of the device of FIG. 1 at different stages of operation in accordance with one embodiment of a further aspect of the invention.
Figure 3:
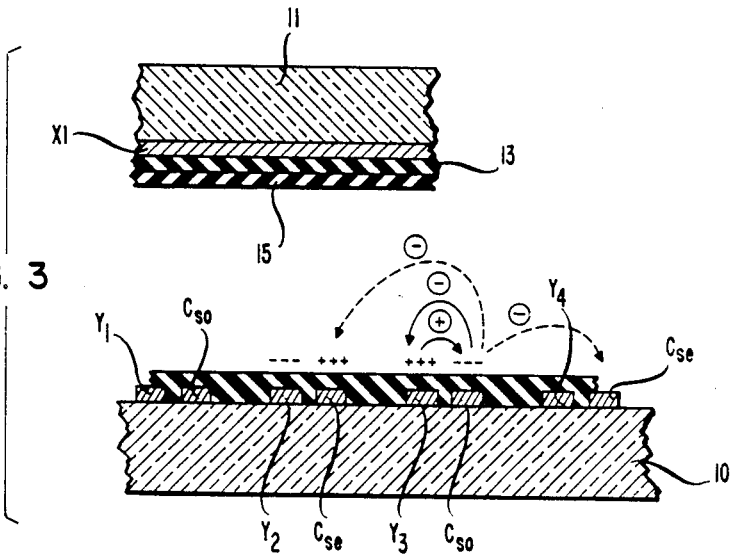

The two substrates are aligned and brought sufficiently close together so that the ribs, 16, make contact with the insulating layer (12, 14) over the bottom substrate, while leaving a gap at least in the areas where the two electrode arrays cross (see, e.g., FIGS. 2 and 3). The gap areas are evacuated and sealed, and an appropriate ionizable gas is introduced into the gaps. In this example, the gas is typically 0.1 percent argon and 99.9 percent neon.

The electrode array on the bottom substrate includes a plurality of pairs of parallel electrodes ($Y_1$-$C_{so}$, $Y_2$-$C_{se}$, $Y_3$-$C_{so}$ and $Y_4$-$C_{se}$) running in a horizontal direction. Thus, each display pel is formed from a pair of electrodes on the bottom substrate and a crossing electrode on the top substrate. This three-electrode per pel structure is advantageous in providing simplification of the read/write and sustain circuitry, which will not be described herein for the sake of brevity. (For a detailed discussion of such a display device, see U.S. patent of G. W. Dick, cited above.)

The present invention focuses on the need for preventing transfer of charge from an active or "on" pel to an adjacent pel during the time that a sustain signal is applied to the electrodes. Such undersired transfer can cause resolution problems if the electrodes of the array are brought sufficiently close together.

Therefore, in accordance with one aspect of the invention, the array of electrodes on the bottom substrate is arranged in a particular manner to avoid transfer of charge between adjacent pels in the direction of the X-electrodes (hereinafter the "vertical" direction). (It will be noted that the ribs, 16, prevent charge transfer in the horizontal direction.) The arrangement involves having one electrode in each pair ($Y_1$, $Y_2$, $Y_3$, and $Y_4$) formed so that it can be independently biased by the addressing circuitry, while the other electrode in each pair ($C_{so}$, $C_{so}$) is connected in common to like electrodes in other pairs. In the preferred example shown, an electrode ($C_{so}$) in each odd pair is electrically coupled to a common bus bar, 17, and similarly, an electrode ($C_{se}$) in each even pair is coupled to a different common bus bar, 18.

Figure 4:
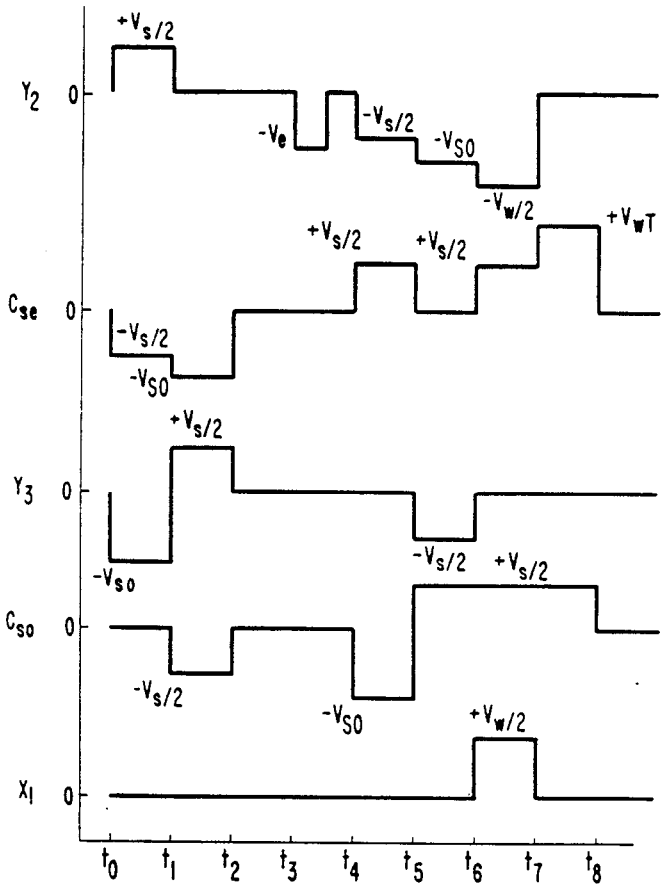
FIG. 4 is an illustration of a typical signal waveform utilized to operate the display device in accordance with the illustrations of FIGS. 2 and 3.

The advantage of such an array configuration can be seen, for example, in the cross-sectional view of the device which is presented in FIGS. 2 and 3, in combination with a typical signal waveform illustrated in FIG. 4, which can be used to operate the device in accordance with another aspect of the invention.

FIGS. 2 and 3 are cross-sectional views along electrode $X_1$ in FIG. 1 illustrating the four display pels made up of electrode $X_1$ and the substrate pairs of $Y_1$-$C_{so}$, $Y_2$-$C_{se}$, $Y_3$-$C_{so}$, and $Y_4$-$C_{se}$. The state of the display shown in FIG. 2 is at some arbitrary time, $t_o$, where the pels including $Y_2$-$C_{se}$ and $Y_3$-$C_{so}$ are active and the pels including $Y_1$-$C_{so}$ and $Y_4$-$C_{se}$ are inactive. At this time, all substrate electrodes receive a sustain signal to maintain the display at the active pels. (Only the signals applied to $Y_2$-$C_{se}$ and $Y_3$-$C_{so}$ are shown for the sake of illustration in FIG. 4. It will be appreciated that the same sustain signals will be applied to every even pair ($Y_2$-$C_{se}$ and $Y_4$-$C_{se}$) and to every odd pair ($Y_1$-$C_{so}$ and $Y_3$-$C_{so}$) of electrodes on the substrate.) The signal applied to electrode $Y_2$ is $+V_s/2$ and to electrode $C_{se}$ is $-V_s/2$, where $V_s$ is the desired total sustain voltage, which is typically approximately 100 volts. The duration of the sustain pulse is typically 10 μsec. This signal causes the positive charge (represented by +) which had collected over electrode $Y_2$ to transfer to the area over electrode $C_{se}$ and the negative charge (represented by −) which had collected over $C_{se}$ to transfer to the area over $Y_2$. This desired transfer of charge is represented by the solid arrows along with the appropriate charge designation within a circle. In a prior art display, the same signals would be applied to the electrodes of the adjacent pel ($+V_s/2$ to $Y_3$ and $-V_s/2$ to the electrode common to all pairs). Thus even if the adjacent pel $Y_3$-$C_{so}$ were inactive, a positive potential would appear at the gas-dielectric surface above electrode $Y_3$ due to the driving signal. This field would have the undesired effect of attracting electrons from the assumed active pel, $Y_2$-$C_{se}$ (as shown by the dotted arrow), thereby building up a surface charge above $Y_3$ and eventually activating this pel. This tendency is increased as the pel spacing is reduced. To a much lesser degree there is also a tendency for the positive charges to stray to an inactive neighbor pel, i.e., from $Y_2$ to $C_{so}$. The effect is reduced due to the much lower velocities of the heavier positive particles (ions).

In accordance with one embodiment of the method aspect of the invention, such undesired charge transfer is prevented by supplying the sustain signal in two phases. The first phase supplies a sustain signal to all even pairs of electrodes (e.g., $Y_2$-$C_{se}$) during the time $t_0$ $t_1$ as shown in FIGS. 2 and 4. The second phase supplies the sustain signal to all odd pairs of electrodes during the time $t_1$ $t_2$ as shown in FIGS. 3 and 4. During the first phase, the common odd electrode ($C_{so}$) is grounded and the Y electrodes in each odd pair (e.g., $Y_3$) have applied thereto a bias ($-V_{so}$) which establishes an essentially zero potential at the surface of the insulating layer thereover for an active pel (i.e., the potential due to positive surface charges above $Y_3$ when it is active is cancelled by the negative bias on the electrode). Similarly, during the second phase, the common even electrode ($C_{se}$) is biased for establishing a zero potential and the Y electrode in each even pair is grounded. Typically, $V_{so}$ is approximately equal to $V_s/2$, but for the purpose of illustration, $V_{so}$ is shown as slightly greater than $V_s/2$ in the figures.

The effect of the two-phase approach is that during the first phase (FIG. 2), the undesired negative charge transfer from above $C_{se}$ to above $Y_3$ is prevented since there is no attractive surface potential above $Y_3$. In the second phase, as shown in FIG. 3, there is no undesired transfer of electrons, as shown by broken arrows, from over $C_{so}$ to either neighboring $C_{se}$ sites. Essentially, only the desired charge transfer between the areas over $Y_3$ and $C_{so}$ will occur in this second phase as shown.

Next, as illustrated in FIG. 4, an erase pulse of magnitude $-V_e$ is applied to the $Y_2$ electrode, where $V_e$ is approximately 70 volts. The pulse is of a duration (approximately 4 μsec) which will neutralize charge over an electrode pair and can be applied to any Y electrode where it is desired to erase that particular line. (In the particular mode shown here, information is erased and rewritten a line at a time. However, modes where individual pels are selectively written and/or erased may also be employed in accordance with the invention.)

The time interval $t_4$ $t_5$ constitutes the first phase of another sustain operation, where this time a sustain signal opposite in polarity to that provided in the $t_0$ $t_1$ interval is applied to even electrode pairs ($Y_2$-$C_{se}$) to accommodate the transfer of charge in the previous sustain operation. To further accommodate this charge reversal, the adjacent Y electrodes (e.g., $Y_3$) are grounded and the $-V_{so}$ bias for establishing a zero surface potential is now switched to the common odd electrodes ($C_{so}$). Similarly, in the second phase of the sustain operation ($t_5$ $t_6$) a sustain signal is applied to the odd electrode pairs ($Y_3$-$C_{so}$) which is opposite in polarity to the previous sustain interval ($t_1$ $t_2$) and the $-V_{so}$ bias is supplied to the even Y electrodes ($Y_2$) while the common even electrodes ($C_{se}$) are grounded.

At time $t_6$, a typical write pulse is supplied to selected X electrodes and selected Y electrodes to initiate a discharge in selected pels (in this example, the pel including $Y_2$-$C_{se}$ which had previously been erased). Specifically, a pulse of $+V_w/2$ is applied to $X_1$ and $-V_w/2$ to $Y_2$ where $V_w$ is approximately 160 volts. The duration of this pulse is typically 8 μsec. This will cause a collection of negative charge on the insulating layer over the $X_1$ electrode and a collection of positive charge over the $Y_2$ electrode. During this portion of the write operation, a potential of $+V_s/2$ is applied to both sets of common electrodes. At time $t_7$ $t_8$, the charge collected over $X_1$ is transferred to the area over the $C_{se}$ electrode by applying thereto a pulse of $+V_{wT}$, which is typically approximately 120 volts in magnitude and 6 μsec in duration. The pel including $Y_2$-$C_{se}$ is, therefore, activated and will display until erased. It will be appreciated that, although the write pulse is shown applied to an even electrode pair by way of example, it is also applied to any odd electrode pair of a display pel which is to be activated. When an odd electrode pair is to be written, the write-transfer pulse ($+V_{wT}$) is applied to the odd common sustain electrodes ($C_{so}$) instead of the even common sustain electrodes as shown in FIG. 4. The normal sustain operation then proceeds after time $t_8$.

If desired, the above-described biasing sequence can be modified so that any particular pair of electrodes will have applied thereto sustain signals of opposite polarity in sequence rather than have the signals separated by application of a sustain signal to the adjacent electrode pair. Thus, for example, a potential of $+V_s/2$ and $-V_s/2$ would be applied to $Y_2$ and $C_{se}$, respectively, in the initial time interval as before. Then a pulse of $-V_s/2$ would be applied to $Y_2$ and a pulse of $+V_s/2$ applied to $C_{se}$ either immediately following or separated from the first signal by an erase pulse. During all this time, a potential of $-V_{so}$ could be applied to $Y_3$, and $C_{so}$ could be grounded. Next, a pulse of $+V_s/2$ and $-V_s/2$ could be applied to $Y_3$ and $C_{so}$, respectively, followed by application of $-V_s/2$ and $+V_s/2$ to $Y_3$ and $C_{so}$, respectively. Again, the switch in polarity to a particular electrode pair could be separated by an erase pulse ($-V_e$) applied to $Y_3$. As before, the other electrode pair is biased by applying $-V_{so}$ to $Y_2$ and grounding $C_{se}$ during the time the sustain signals are applied to $Y_2$ and $C_{se}$. The write pulses would be applied in the same manner as previously described.

It is also possible, utilizing the structure of the invention, to operate the display in a way which will reduce crosstalk without the need for applying the sustain signal in two phases as discussed above. This alternative mode of operation is illustrated in the cross-sectional view of the display in FIG. 5 and in the waveform diagrams of FIG. 6. Here, again, desired transfer of charge during a sustain phase is illustrated by solid arrows and undesired transfer by broken-line arrows. Purely for illustrative purposes, the display pel including $Y_3$-$C_{so}$ is shown as active while the other display pels are shown as inactive. The charge transfer illustrated in FIG. 5 takes place at time $t_0$, where, as illustrated in FIG. 6, a bias of $+V_s/2$ is applied to $Y_3$ and a bias of $-V_s/2$ is applied to $C_{so}$. However, rather than apply a bias of $V_{so}$ and grounding electrodes in the adjacent pairs, a sustain signal is also applied to these electrodes ($Y_2$-$C_{se}$ and $Y_4$-$C_{se}$) but of an opposite polarity to that of the odd pairs. Thus, for example, a bias of $-V_s/2$ is applied to $Y_2$ and a bias of $+V_s/2$ is applied to $C_{se}$. This mode of operation eliminates the need of applying the sustain signal in sequence to alternate pairs of electrodes, but improves resolution because the polarity is such that any undesired transfer from an electrode in an active pel (e.g., $C_{so}$) to an adjacent pair ($Y_2$-$C_{se}$ or $Y_4$-$C_{se}$) can only occur to the area over an electrode ($C_{se}$) which is one electrode removed from the transfer or electrode. This significantly increases the distance of travel for undesired transfer thus reducing the possibility of such transfer. (It will be appreciated that the same effect applies to transfer of positive charge which is not shown for the sake of clarity in the illustration.)

At time $t_1'$, a write signal is applied to the even Y electrodes and the X electrode, and the charge accumulated over the X electrode is transferred to over $C_{se}$ by application of $V_{wt}$ thereto at time $t_2'$-$t_3'$. At the same time, an erase pulse ($-V_e$) is applied to any desired odd Y electrodes. This is followed by a sustain signal applied to all electrodes at $t_3'$-$t_4'$. Next, at time $t_4'$-$t_5'$, a write signal is applied to $X_1$ and the odd Y electrodes, followed by transferring of charge from over $X_1$ to over $C_{so}$ by application of $V_{wt}$ at time $t_5'$-$t_6'$. An erase pulse is also applied to any desired even Y electrodes at $t_5'$-$t_6'$. The normal sustain operation continues at $t_6'$-$t_7'$.

Figure 7:
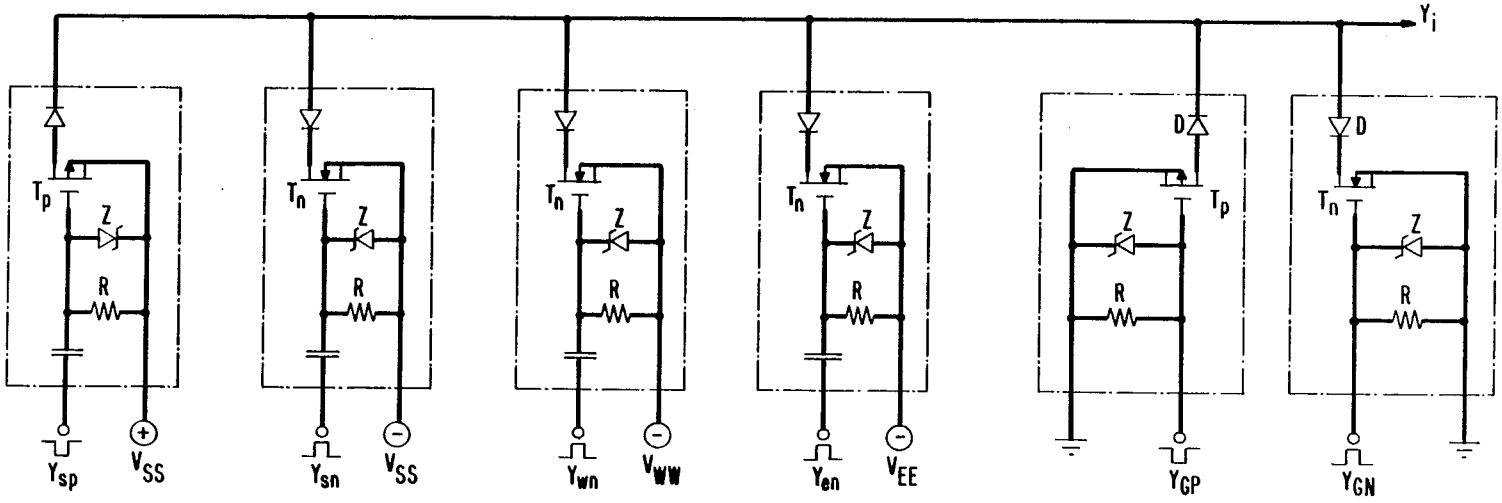
FIGS. 7 and 8 are circuit diagrams of circuits useful for operating the display in accordance with either embodiment of the said further aspect of the invention.
Figure 8:
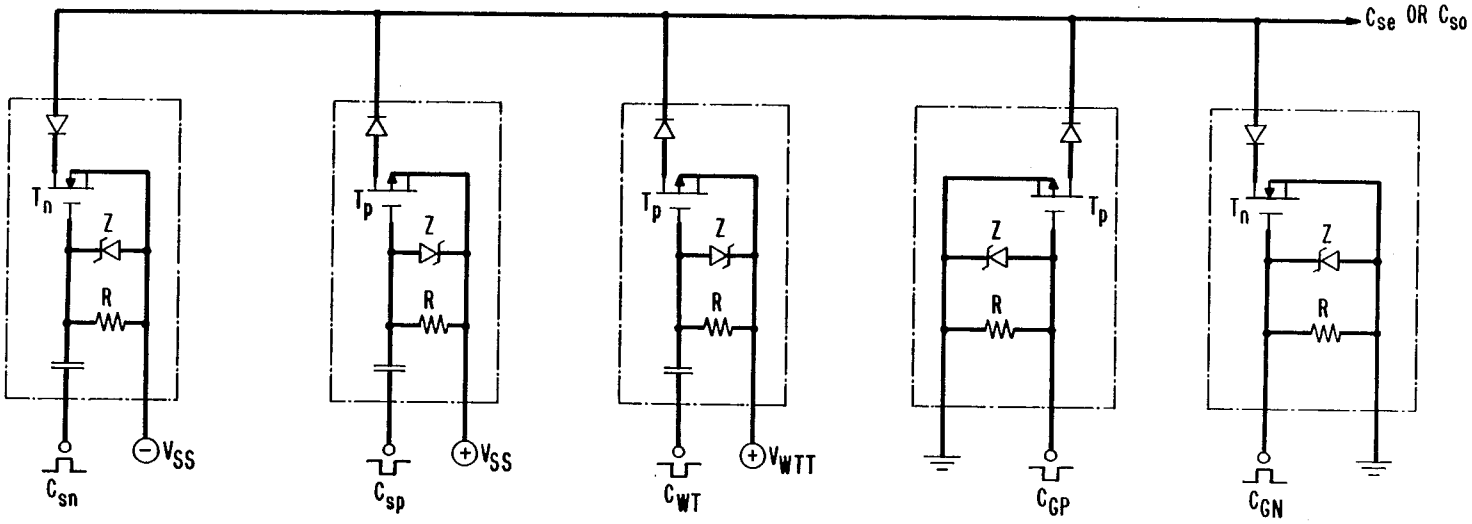

FIGS. 7 and 8 illustrate examples of circuitry which could be used to bias the individually addressable (Y) electrodes and the common ($C_{se}$ or $C_{so}$) electrodes, respectively, in order to obtain any of the operations described above. In FIG. 7, $Y_{sp}$ represents a logic pulse for applying the positive sustain signal ($+V_s/2$) and $Y_{sn}$ represents the pulse for applying the negative sustain signal ($-V_s/2$). The pulses are typically approximately 10 volts in magnitude. Application of these pulses controls the conduction of FETs, labeled $T_p$ and $T_n$ which, in turn, apply the bias potential ($+V_{ss}$ or $-V_{ss}$) to the appropriate Y electrode. Similarly, $Y_{wn}$ is the write logic pulse and $Y_{en}$ is the erase logic pulse which control application of the write pulse bias ($-V_{ww}$) or the erase pulse bias ($-V_{EE}$) to the Y electrode by means of n-channel FETs ($T_n$). Further, $Y_{gp}$ and $Y_{gn}$ represent logic pulses which, respectively, raise and lower the Y electrodes to ground potential. In the circuit, Z represents zener diodes, C represents capacitors, R represents resistors and D designates diodes. It will be appreciated that the bias potentials ($+V_{ss}$, $-V_{ss}$, $-V_{ww}$ and $-V_{EE}$) are inputs from power supplies which can be dc or pulsed power supplies. The circuit of FIG. 8 operates in a similar manner with $C_{sp}$ representing the logic pulse for applying a positive sustain signal and $C_{sn}$ representing a logic pulse for applying the negative sustain signal to the common electrodes ($C_{se}$ or $C_{so}$). Again, the appropriate bias ($+V_{ss}$ or $-V_{ss}$) is applied through a p-channel or n-channel channel FET ($T_p$ and $T_n$, respectively). $C_{wt}$ represents the logic pulse for transferring charge from the X electrode to the $C_{so}$ or $C_{se}$ electrode during the write phase (e.g., time $t_7$ $t_8$ of FIG. 4). $C_{gp}$ and $C_{gn}$ represent logic pulses for, respectively, raising and lowering the potential of $C_{se}$ or $C_{so}$ to ground. It will be appreciated that these circuits are designed so that $V_{so}$ of FIG. 4 is equal to $V_s/2$.

Figure 5:
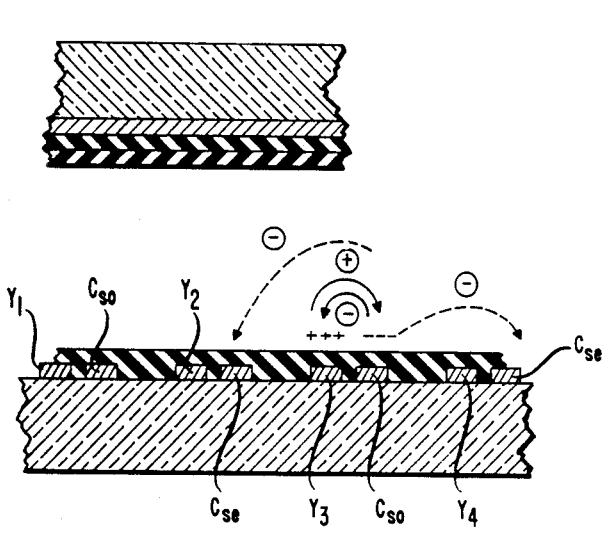
FIG. 5 is a cross-sectional, schematic view of the device of FIG. 1 during one stage of operation in accordance with a further embodiment of the said further aspect of the invention.
Figure 6:
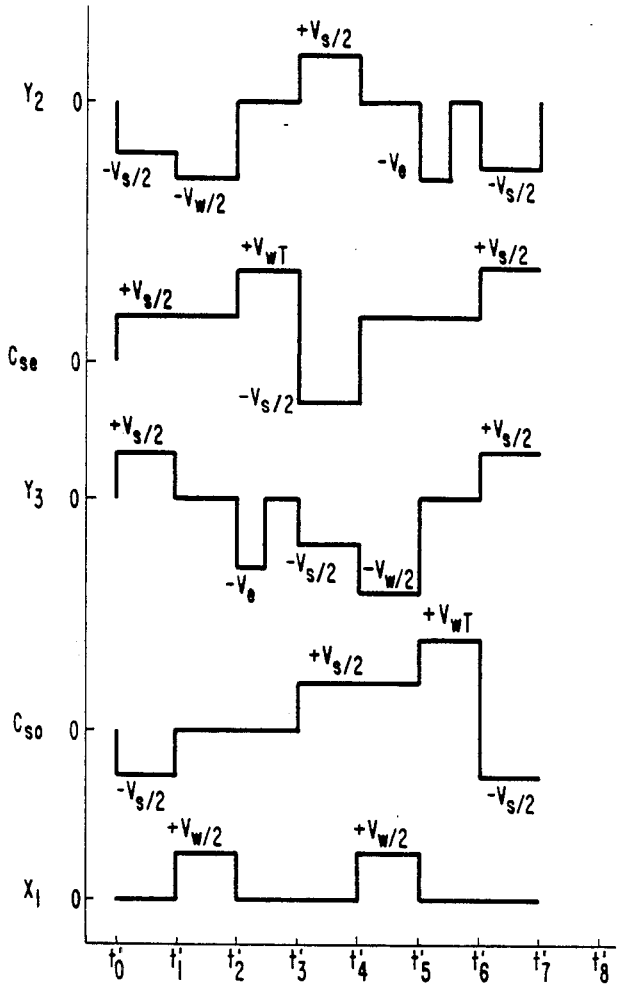
FIG. 6 is an illustration of a typical signal waveform utilized to operate the display device in accordance with the illustration of FIG. 5.
Figure 10:
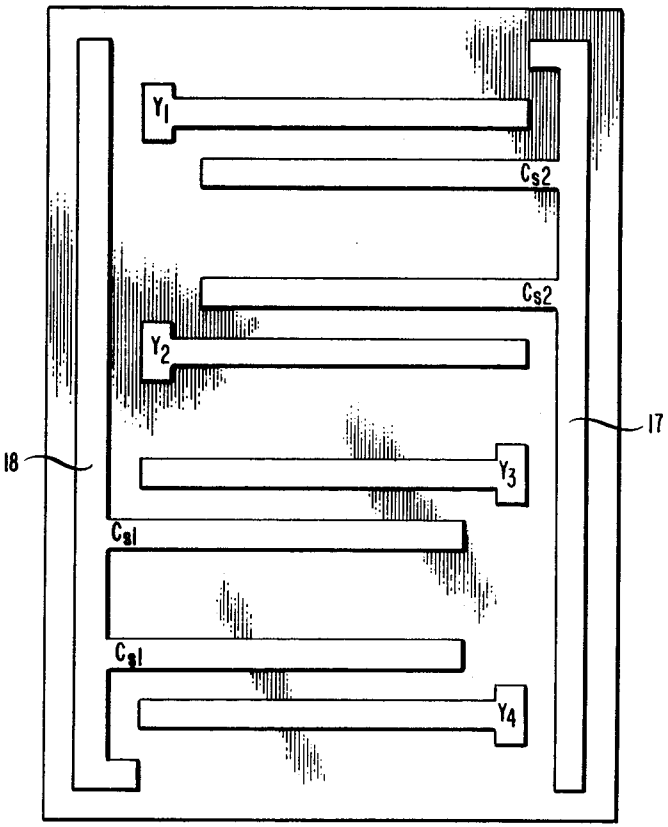
FIGS. 9 and 10 are plan views of Y-electrode arrays in accordance with further embodiments of the invention.
Figure 9:
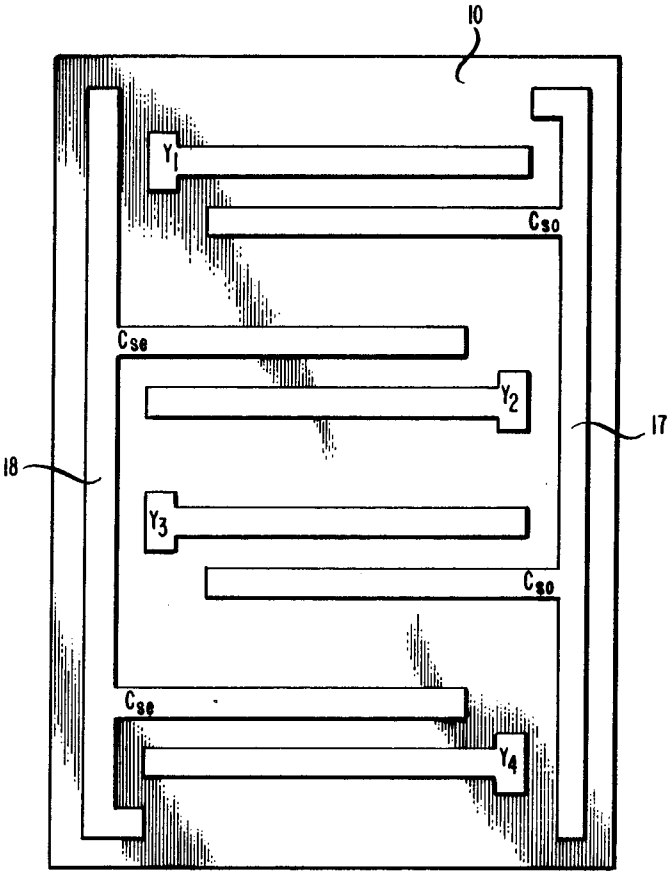

It is also possible to design the Y electrode array to achieve the same effect as shown in FIG. 5 without applying different polarity signals to adjacent pairs. This is accomplished as shown in FIG. 9 by alternating the sequence of the individually addressable and common electrodes in the odd and even pairs. Thus, in the vertical direction, the Y ($Y_1$, $Y_3$) electrode precedes the common electrode ($C_{so}$) in the odd pairs and the common electrode ($C_{se}$) precedes the Y electrodes ($Y_2$, $Y_4$) in the even pairs. The same sustain signal can now be applied to each Y electrode and to each common electrode while preventing undesired transfer from occurring to a nonadjacent electrode as before. The layout of FIG. 9 can be further altered as shown in FIG. 10 so that the common electrodes in adjacent pairs (now labeled $C_{s2}$) can be coupled to a common bus bar, 17, while the common electrodes in another adjacent pair ($C_{s1}$) are coupled to another common bus, 18. Such a configuration could provide more space for electrical connections to the Y electrodes.

It will be appreciated that, although common connections to electrodes in every odd and even pairs or every two adjacent pairs is shown and preferred, the invention might also be applicable where common connections are applied to every third or more pair of electrodes. Further, although each pel is shown as comprising a pair of electrodes on the substrate and one electrode on the cover, some variations in structure are possible. For example, the X electrodes could also be formed over the substrate and separated from the Y and C electrodes by a dielectric to form a "single substrate" design (see, for example, U.S. Pat. No. 4,164,678 issued to Biazzo et al). Further, each pel could include at least one additional electrode coplanar with the Y and C electrodes in order to provide a possible simplification of the sustain and write/erase circuitry. (See U.S. patent of G. W. Dick, previously cited.)

Various additional modifications of the invention will become apparent to those skilled in the art. All such variations which basically rely on the teachings through which the invention has advanced the art are properly considered within the scope of the invention.

What is claimed is:

1. A display device comprising:

first and second substrates placed so as to define a gap region between them with a gas capable of forming a glow discharge occupying the gap;

first and second arrays of electrodes formed in the gap region, covered by dielectric layers, and positioned to form crosspoint regions between the electrodes of the two arrays, said first array comprising a plurality of rows of at least pairs of electrodes spaced in at least the crosspoint regions so that a glow discharge may be sustained at the surface of the dielectric in said regions; characterized in that one electrode in each pair of the first array is capable of being biased independently of all other electrodes in the first array, and the other electrode in each pair is electrically coupled in common to such electrodes in other pairs, the common electrodes being formed in at least two sets of electrodes which are capable of being independently biased.

2. The device according to claim 1 wherein the said other electrodes in every even pair are electrically coupled together, and the said other electrodes in every odd pair are electrically coupled together.

3. The device according to claim 2 wherein the position of the said one electrode and said other electrode is reversed in every adjacent pair.

4. The device according to claim 1 wherein the said other electrodes in every adjacent pair are electrically coupled together.

5. The device according to claim 1 wherein adjacent pairs of electrodes are spaced less than 3 mils apart.

6. The device according to claim 1 further comprising means for biasing the electrodes of the first array so that adjacent pairs have a different signal applied thereto in order to maintain the glow discharge in the crosspoint regions.

7. The device according to claim 6 wherein the biasing means includes means for applying a signal of opposite polarities to adjacent pairs.

8. The device according to claim 6 wherein the biasing means includes means for applying an AC signal alternatively to adjacent pairs of electrodes.

9. A method of operating a display device which includes first and second substrates placed so as to define a gap region between them with a gas capable of forming a glow discharge occupying the gap, and first and second arrays of electrodes formed in the gap region, which electrodes are covered by dielectric layers and positioned to form crosspoint regions between the electrodes of the two arrays and where the first array comprises a plurality of at least pairs of electrodes spaced at least in the crosspoint regions so that a glow discharge may be sustained at the surface of the dielectric between the electrodes of each pair in the crosspoint regions, the method of sustaining the glow discharge at selected crosspoint regions comprising the steps of applying AC signals to both electrodes of each pair so that adjacent pairs have different signals applied thereto at a particular time.

10. The method according to claim 9 wherein the AC signals are applied alternatively to adjacent pairs.

11. The method according to claim 10 wherein, during the time that an AC signal is applied to a particular pair, the adjacent pair has applied thereto a signal to create a potential at the dielectric layer over the electrodes which prevents transfer of charge formed from the ionizable gas.

12. The method according to claim 9 wherein AC signals of opposite polarities are applied simultaneously to adjacent pairs of electrodes.

* * * * *